US008664169B2

(12) United States Patent
Bouffet

(10) Patent No.: US 8,664,169 B2
(45) Date of Patent: Mar. 4, 2014

(54) LUBRICATING COMPOSITIONS FOR TRANSMISSIONS

(75) Inventor: Alain Bouffet, Taluyers (FR)

(73) Assignee: Total Marketing Services, Puteaux (FR)

( * ) Notice: Subject to any disclaimer, the term of this patent is extended or adjusted under 35 U.S.C. 154(b) by 139 days.

(21) Appl. No.: 13/121,428

(22) PCT Filed: Oct. 2, 2009

(86) PCT No.: PCT/IB2009/007026
§ 371 (c)(1),
(2), (4) Date: Mar. 29, 2011

(87) PCT Pub. No.: WO2010/038147
PCT Pub. Date: Apr. 8, 2010

(65) Prior Publication Data

US 2011/0177989 A1 Jul. 21, 2011

(30) Foreign Application Priority Data

Oct. 3, 2008 (FR) ..... 08 05471

(51) Int. Cl.
*C10M 169/04* (2006.01)

(52) U.S. Cl.
USPC ..... 508/110; 508/463; 508/469; 508/591

(58) Field of Classification Search
USPC ..... 508/463, 110, 469, 591
See application file for complete search history.

(56) References Cited

U.S. PATENT DOCUMENTS

| | | | | |
|---|---|---|---|---|
| 4,956,122 | A | 9/1990 | Watts et al. | |
| 5,338,471 | A | 8/1994 | Lal | |
| 6,835,698 | B2 * | 12/2004 | Egawa et al. | 508/591 |
| 2004/0116307 | A1 | 6/2004 | Ganemi | |
| 2004/0144952 | A1 | 7/2004 | Stewart | |
| 2005/0119134 | A1 | 6/2005 | Tequi et al. | |
| 2005/0215441 | A1 * | 9/2005 | Mackney et al. | 508/291 |
| 2008/0153724 | A1 | 6/2008 | Tequi et al. | |
| 2008/0280793 | A1 | 11/2008 | Tequi et al. | |
| 2008/0312114 | A1 | 12/2008 | Ritter | |
| 2009/0270294 | A1 | 10/2009 | Souchez et al. | |
| 2011/0003724 | A1 | 1/2011 | Bouffet | |

FOREIGN PATENT DOCUMENTS

| | | | |
|---|---|---|---|
| CN | 1831097 | A | 9/2006 |
| EP | 1785479 | A1 | 5/2007 |
| WO | WO99/02628 | | 1/1999 |
| WO | WO02/079361 | | 10/2002 |
| WO | WO 02079361 | A1 * | 10/2002 |

(Continued)

OTHER PUBLICATIONS

Ronald L. Shubkin: "Polyalphaolefins" CRC Handbook of Lubrication and Tribology: Theory of Tribology, Jan. 1, 1992 (Jan. 1, 1993), pp. 219-236, XP009108705.

(Continued)

*Primary Examiner* — Taiwo Oladapo
(74) *Attorney, Agent, or Firm* — Harness, Dickey & Pierce, P.L.C.

(57) ABSTRACT

The present disclosure relates to lubricating compositions for transmissions, in particular for gear boxes, and to the use thereof for limiting the fuel consumption of motor vehicles. The compositions according to the disclosure are suitable for all types of vehicles, especially light vehicles, and are particularly suitable for hybrid engine vehicles.

17 Claims, 1 Drawing Sheet

(56) References Cited

FOREIGN PATENT DOCUMENTS

| | | |
|---|---|---|
| WO | WO2006/032012 | 3/2006 |
| WO | WO-2008/026016 A2 | 3/2008 |
| WO | WO2009/125075 | 10/2009 |

OTHER PUBLICATIONS

Masjuki, H. H. et al: "Palm Oil Methyl Esters As Lubricant Additive in a Small Diesel Engine", Journal of the American Oil Chemists' Society, Springer, Berlin, DE, vol. 72, No. 5, Jan. 1, 1995 (Jan. 1, 1995), pp. 609-612, XP002948177.

* cited by examiner

Description of NEDC cycle.
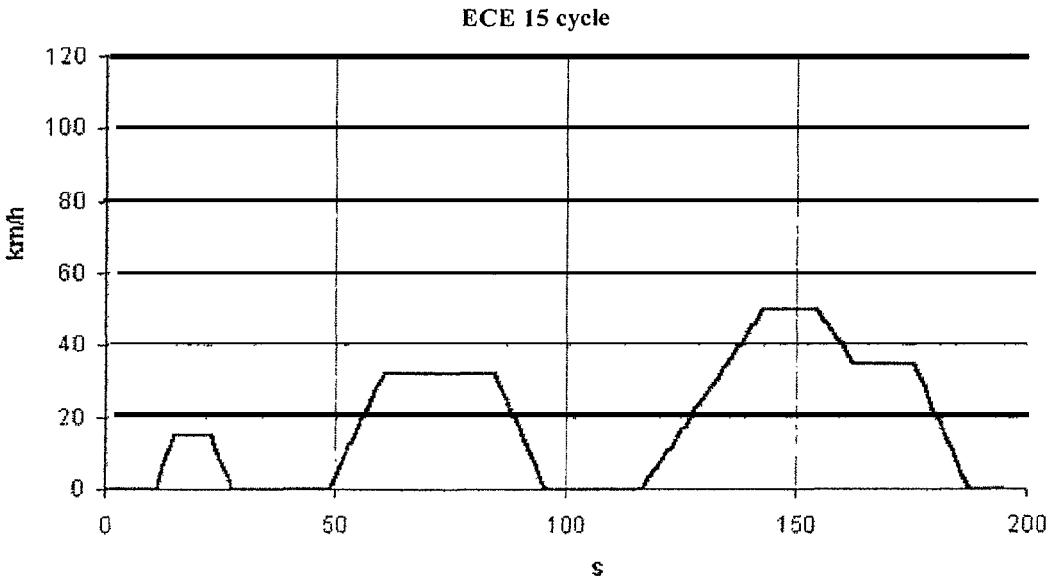
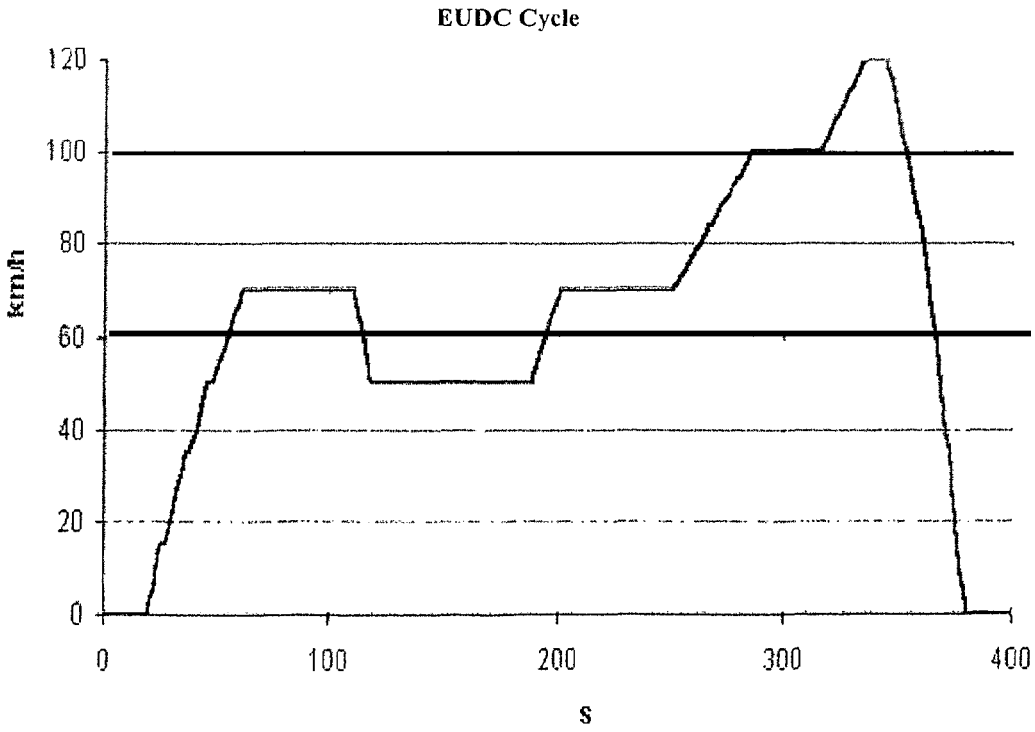

LUBRICATING COMPOSITIONS FOR TRANSMISSIONS

CROSS-REFERENCE TO RELATED APPLICATIONS

This application is a National Phase Entry of International Application No. PCT/IB2009/007026, filed on Oct. 2, 2009, which claims priority to French Patent Application Serial No. 08 05 471, filed on Oct. 3, 2008, both of which are incorporated by reference herein.

TECHNICAL FIELD

The present invention relates to lubricating compositions for transmissions, in particular for gear boxes, and to their use for limiting fuel consumption of motor vehicles. The compositions according to the invention are suitable for any types of vehicles, notably light duty vehicles, and are particularly suitable for vehicles with hybrid engines.

BACKGROUND

Present environmental concerns, notably with view to reducing carbon dioxide emissions, induce an urgent need for reducing fuel consumption of light duty automotive vehicles or trucks, as well as building site machines or agricultural machines. In particular, there exists an increasing demand for organs such as the engine, the transmissions, the reduction gears, the compressors and hydraulic systems which contribute to reducing energy consumption. Accordingly, the lubricants used in these organs should allow reduction of frictional and splashing losses to a level as low as possible. It is known to one skilled in the art that lowering the viscosity of the lubricant oil is a means for improving fuel savings achieved at the transmissions.

Power train (PT) bench tests including an engine/gear boxes assembly have thereby shown that fuel savings which are made are directly proportional to the viscosity of the transmission lubricant at the operating temperature, which is generally located between 20 and 40° C. for a use of the vehicles on short trips. The best performances are obtained with oils of kinematic viscosity measured according to the ASTM D445 standard, to be located at about 20 $mm^2/s$ at the operating temperature. Moreover, manufacturers' specifications systematically impose for transmission oils for private vehicles, a viscosity at 100° C. (or KV 100) as measured according to the ASTM D445 standard, comprised between 5 and 15 $mm^2/s$, most often comprised between 6 and 9 $mm^2/s$, preferentially targeted around 6.5 $mm^2/s$. This limitation is related to mechanical design considerations for gear boxes, bearings, gears. Indeed, below a limiting viscosity of about 5 $mm^2/s$, the dimensioning of the parts should be modified in order to reduce the load per unit surface, since the lubricant does not sufficiently participate in supporting said load.

The viscosity behavior of oils strongly depends on the bases used, in their formulation, in an amount of at least 50% by mass in general. Thus, the formulation of transmission oils having a strong effect on fuel savings, or further strong fuel-saving properties or so-called "fuel eco" properties, will preferentially resort to lubricant bases having a very high viscosity index or VI. The viscosity index or VI of a base measured according to the ASTM D2270 standard quantifies its capacity of limiting its temperature-dependent changes in viscosities, from the measurement of its kinematic viscosity at 40° C. (KV40) and 100° C. (KV100) measured according to the ASTM D445 standard.

The VI of known conventional mineral bases is at most of the order or 200. With certain synthetic oils, it is possible to attain very high VIs, of the order of 400, but this high VI is accompanied either by strong viscosity or by constraints on solubility of the additives, with which it is not possible to impart to the lubricant, properties for protecting the gears, for controlling friction, . . . , expected by the manufacturer. It is therefore difficult to formulate transmission oil with eco fuel properties in majority from these bases. Their cost and their availability are also a problem for large scale industrialization of lubricants incorporating them in majority.

Certain fatty acid esters of natural origin intrinsically have a very high VI of the order of 250, or even 300 and beyond, combined with low viscosity. However, one skilled in the art is not encouraged to use these esters for automotive lubricants, in particular for engines and transmissions, since the esters of this type, liquid at room temperature, have at least one double bond on their acid chain, which gives them very low resistance to oxidation, whence a risk of degradation during operation. These esters, used as bases, do not in particular satisfy high temperature oxidation tests, either catalyzed or not, which are part of the specification of automotive manufacturers for these applications.

Surprisingly, the applicant noticed that it was possible to formulate transmission oils with very high VI, of more than 250 or further 280, preferentially more than 300, or even of the order of 320 and beyond, from bases of natural origin of the fatty acid methyl ester types, and having an operating lifetime comparable with that of existing commercial products. Oils for gear boxes in particular should be designed for "filled for life" conditions, i.e. they are never emptied throughout the lifetime of the vehicle. Without intending to be bound by any theory, it seems that these esters, which form, at the surfaces of the frictional parts, films with which hydrodynamic flow conditions may be maintained under a high load, limit heating of the oils during operation. Thus, in spite of the poor results on the standard oxidation tests, the operating results are quite satisfactory.

SUMMARY

The present invention relates to lubricating compositions for gear boxes, with a kinematic viscosity at 100° C. measured according to the ASTM D445 standard, comprised between 5.5 and 7 $mm^2/s$, comprising one or more phosphorus-containing, sulfur-containing or phosphorus-sulfur-containing antiwear and/or extreme pressure additives, at least 30% by weight of at least one fatty acid methyl ester of formula $RCOOCH_3$, wherein R is a paraffinic or olefinic group containing from 11 to 23, preferentially from 13 to 19 carbon atoms, and either at least one compound selected from the group of heavy polyalphaolefins with a kinematic viscosity at 100° C. measured according to the ASTM D445 standard comprised between 40 and 3,000 $m^2/s$ and with a molecular mass by weight above 2,500 daltons, or at least one compound selected from the group of light-weight polyalphaolefins with a kinematic viscosity at 100° C. measured according to the ASTM D445 standard comprised between 1.5 and 6 $mm^2/s$, with a kinematic viscosity at 40° C. measured according to the ASTM D445 standard, comprised between 4 and 32 $mm^2/s$, and a molecular mass by weight of less than 500 daltons, in combination with one or more compounds of the polymethacrylate type with a molecular mass by weight below 30,000 daltons.

According to an embodiment, the lubricant composition comprises at least 20% by weight of at least one fatty acid methyl ester of formula $R_1COOCH_3$, wherein $R_1$ is a mono-, di- or tri-unsaturated olefinic group containing from 11 to 23, preferentially from 15 to 19 atoms, preferentially 17 carbon atoms. According to an embodiment, the lubricant composition comprises at least 20% by weight of at least one fatty acid methyl ester of formula $R_2COOCH_3$, wherein $R_2$ is a mono-unsaturated group containing from 11 to 23, preferentially from 15 to 19 atoms, preferentially 17 carbon atoms. Preferably, the unsaturations of the olefinic groups $R_1$ and/or $R_2$ are in the cis configuration. Preferably in the lubricating composition, the mass percentage of heavy polyalphaolefin(s) is at least 10% and the mass percentage of fatty acid methyl ester(s) is at least 60%.

According to an embodiment, the lubricating composition comprises at least 50% by weight, preferentially at least 55% by weight, at least one fatty acid methyl ester of formula $R_1COOCH_3$, wherein $R_1$ is a mono- di- or tri-unsaturated olefinic group containing from 11 to 23, preferentially from 15 to 19 atoms, preferentially 17 carbon atoms. According to an embodiment, the lubricating composition comprises at least 45% by weight, preferentially at least 50% by weight, of at least one fatty acid methyl ester of formula $R_2COOCH_3$, wherein $R_2$ is a mono-unsaturated olefinic group containing from 11 to 23, preferentially from 15 to 19 atoms, preferentially 17 carbon atoms. Preferably in the lubricating composition, the mass percentage of lightweight polyalphaolefin(s) is at least 10% and the mass percentage of the mixture of polymethacrylate(s) and fatty acid methyl ester(s) is at least 60%. Preferably, in the lubricating composition, the ratio between the mass percentage of polymethacrylate(s) and the mass percentage of fatty acid ester(s) is comprised between 0.8 and 1.2.

According to an embodiment, the lubricant composition comprises at least 85% by weight, preferentially at least 90% by weight, even more preferentially at least 95% by weight, of one or more fatty acid methyl esters of formula $RCOOCH_3$, wherein R is a paraffinic or olefinic group containing from 11 to 23, preferentially from 13 to 19 carbon atoms, based on the total weight of fatty acid esters present in said lubricating composition. According to an embodiment, the lubricating composition comprises at least 75% by weight, preferentially at least 80% by weight of at least one fatty acid methyl ester of formula $R_1COOCH_3$, wherein $R_1$ is a mono- di- or tri-unsaturated olefinic group containing from 11 to 23, preferentially from 15 to 19 atoms, preferentially 17 carbon atoms, based on the total weight of fatty acid esters present in said lubricating composition. According to an embodiment, the lubricating composition comprises at least 65% by weight, preferentially at least 70% by weight of at least one fatty acid methyl ester of formula $R_2COOCH_3$, wherein $R_2$ is a mono-unsaturated olefinic group containing from 11 to 23, preferentially from 15 to 19 atoms, preferentially 17 carbon atoms, based on the total weight of fatty acid esters present in said lubricating composition. Preferably, the unsaturations of the olefinic groups $R_1$ and/or $R_2$ are in the cis configuration.

According to an embodiment, the lubricating composition comprises at most 15% by weight, preferentially at most 10% by weight, of saturated fatty acid esters, based on the total weight of fatty acid esters present in said lubricating composition. According to an embodiment, in the lubricating composition, the ratio S/P between the mass content of the sulfur element measured according to the ASTM D2622 standard and the content of the phosphorus element measured according to the ASTM D5185 standard in said lubricating compositions is comprised between 3 and 60, preferentially less than 30, preferentially less than 20, even more preferentially less than 10, or further comprised between 5 and 10. According to an embodiment, the lubricant composition has a VI, as measured according to the ASTM D2270 standard, of greater than 250, preferentially greater than 280, still more preferentially greater than 300.

Another aspect of the invention relates to the use of lubricating compositions for gear boxes as described above, in order to generate fuel savings of more than 1%, preferentially more than 2.5%, measured under standard conditions of the NEDC test according to the directive EEC 90/C81/01 setting national upper emission limits for certain atmospheric pollutants "emission test cycles for the certification of light duty vehicles in Europe", Brussels, 2001), on motor vehicles equipped with manual or automatic gear boxes, or with automated manual gear boxes. Preferably, the fuel savings are generated on light duty vehicle engines, preferentially hybrid vehicles. A preferential use relates to vehicles equipped with a manual gear box or automated manual gear boxes.

Finally, the present invention relates to the use of fatty acid methyl ester bases containing at least 85% by weight, preferentially at least 90%, and even more preferentially at least 90% of fatty acid methyl esters of formula $RCOOCH_3$, wherein R is a paraffinic or olefinic group containing from 11 to 23, preferentially from 13 to 19 carbon atoms, with VI greater than 250, and with a kinematic viscosity at 100° C. of less than 7 $mm^2/s$, as a lubricating base for formulating gear box oils in order to generate fuel savings of more than 1%, preferentially more than 2.5%, measured under the standard additions of the NEDC test according to the directive EEC 90/C81/0101 setting national upper emission limits for certain atmospheric pollutants ("emission test cycles for certification of light duty vehicles in Europe", Brussels, 2001). Preferably, compositions are used, which comprise at least 75% by weight, preferentially at least 80% by weight of at least one fatty acid methyl ester of formula $R_1COOCH_3$, wherein $R_1$ is a mono- di- or tri-unsaturated olefinic group containing from 11 to 23, preferentially from 15 to 19 atoms, preferentially 17 carbon atoms. Preferably, compositions are used which comprise at least 65% by weight, preferentially at least 70% by weight of at least one fatty acid methyl ester of formula $R_2COOCH_3$, wherein $R_2$ is a mono-unsaturated olefinic group containing from 11 to 23, preferentially from 15 to 19 atoms, preferentially 17 carbon atoms. Preferably, compositions are used wherein the unsaturations of the olefinic groups $R_1$ and/or $R_2$ are in the cis configuration.

DETAILED DESCRIPTION OF THE INVENTION

The lubricant compositions according to the invention are compositions for transmissions, more particularly for gear boxes, with which significant fuel savings may be made on vehicles, in particular on light duty vehicles, notably hybrid vehicles. These fuel savings are measured by submitting a power train to the test bench or an actual vehicle to an NEDC model cycle, (also designated as ECE/EUDC cycle) according to the directive EEC 90/C81/01 setting national upper emission limits for certain atmospheric pollutants ("emission test cycles for the certification of light duty vehicles in Europe") Brussels, 2001). These performances are strongly correlated with their low kinematic viscosity, notably their kinematic viscosity at 40° C. (representative of the operating temperature on short trips), which is of the order of 20 to 25 $mm^2/s$, measured according to the ASTM D445 standard.

For considerations on protecting mechanical parts, the oils according to the invention have a kinematic viscosity at 100° C. imposed by the manufacturers comprised between 5.5 and 7 $mm^2/s$, preferentially between 6 and 7 $mm^2/s$, even more preferentially between 6 and 6.7 $mm^2/s$, measured according to the ASTM D445 standard. Thus, the oils according to the invention should, in order to ensure their protective role for mechanical parts while generating fuel savings, have high VIs (ASTM 2270), greater than 250, preferentially greater than 220, even more preferentially greater than 300, or of the order of 320 and more. For this purpose, these oils according to the invention are formulated from lubricant bases of the fatty acid methyl ester type with a high VI (greater than 250), and with a kinematic viscosity at 100° C. of less than 7 $mm^2/s$, such as those described hereafter, combined with heavy PAOs, or else with lightweight PAOs in association with PMAs, and/or optionally certain other compounds known to one skilled in the art as thickening additives.

In particular, the oils according to the invention contain at least 30% by weight of at least one fatty acid methyl ester of formula $RCOOCH_3$, wherein R is a paraffinic or olefinic group containing from 11 to 23, preferentially from 13 to 19 carbon atoms. With this minimum content it is possible to reach the high VIs and the low viscosity during operation generating the fuel-saving effect. The oils according to the invention may contain at least 35, at least 50, or further at least 60, 70, or 80% of such fatty acid methyl esters. It should be noted that very high contents of such esters, beyond 70% by weight, or beyond 80% by weight, may have an unfavorable effect on the level of insoluble materials formed during the ageing of the oil. This is why their content will generally be comprised between 30 and 80%, or further between 30 and 70%. In the alternatives containing lightweight PAO in combination with PMA, their content will generally be comprised between 30 and 50%, or further between 30 and 40%.

Preferentially, the majority fatty acid methyl esters are of formula $R_1COOCH_3$, wherein $R_1$ is a mono- di- or tri-unsaturated olefinic group containing from 11 to 23, preferentially from 15 to 19 atoms, preferentially 17 carbon atoms. The lubricating compositions for gear boxes according to the invention preferentially contain at least 20% by weight, preferentially at least 25% by weight of such esters. Still more preferentially, the majority fatty acid methyl esters are of formula $R_2COOCH_3$, wherein $R_2$ is a mono-unsaturated olefinic group containing from 11 to 23, preferentially from 15 to 19 atoms, preferentially 17 carbon atoms. The lubricating compositions for gear boxes according to the invention preferentially contain at least 20% by weight of such esters.

All these esters preferentially stem from fatty acid methyl ester bases as described below. The base system of the lubricants according to the present invention may also be completed with other bases, insofar that the VI of said lubricating compositions is greater than 250, preferentially greater than 280, still further preferentially greater than 300 or of the order of 320 and more, and the kinematic viscosity at 100° C. of said lubricating compositions is comprised between 5.5 and 7 $mm^2/s$, preferentially between 6 and 6.5 $mm^2/s$. These other bases may be bases of mineral, synthetic or natural origin. However, preferentially, no base containing fatty acid esters other than the fatty acid methyl ester bases described below will be used.

Fatty Acid Methyl Ester Bases

The bases said to be of the fatty acid ester type, used in the formulation of lubricants according to the invention, here designated by "fatty acid methyl ester bases" are in fact fatty acid ester mixtures, comprising at least 85% by weight, preferentially at least 90% or at least 92%, preferentially at least 95%, still more preferentially at least 98% or further at least 99% by weight of fatty acid methyl esters, of formula $RCOOCH_3$, wherein R is a paraffinic or olefinic group containing from 11 to 23, preferentially from 13 to 19 carbon atoms. The fatty acid methyl ester bases used in the lubricants according to the invention are also preferentially and practically free of impurities of the ethyl ester type or more generally of alcohol esters including 2 carbon atoms or more. They are also practically free of mono- di- or tri-glycerides, or further of compounds of the sterol (vitamin E) type, or tocopherols. Such impurities may indeed have an impact on the viscosity level and the VI of the ester bases, notably leading to lower values of VI than desired (VIs of less than 250). Thus, the total contents of such impurities will be less than 15% by mass, preferentially less than 10%, or 8% or 5% by mass in the ester bases used for formulating the lubricants according to the invention, still further preferentially less than 2% or less than 1% by mass.

These fatty acid methyl ester bases preferentially contain at least 70% by weight, preferentially at least 75%, still more preferentially at least 80% by weight of at least one fatty acid methyl ester of formula $R_1COOCH_3$, wherein $R_1$ is a mono- di- or tri-unsaturated olefinic group containing from 11 to 23, preferentially from 15 to 19 atoms, preferentially 17 carbon atoms. Preferentially, these fatty acid methyl ester bases contain at least 65% by weight, preferentially at least 70% by weight of at least one fatty acid methyl ester of formula $R_2COOCH_3$, wherein $R_2$ is a mono-unsaturated olefinic group containing from 11 to 23, preferentially from 15 to 19 atoms, preferentially 17 carbon atoms. Preferably, the average chain length of the fatty acids making up the esters of said bases is comprised between 17 and 19.

In these fatty acid methyl ester bases, the unsaturation(s) of the groups $R_1$ and/or $R_2$ are preferentially in the cis form. The "cis" configuration designates the "boat" form, where both hydrogens are on the same side of the double bond C=C, the "trans" configuration designates the chair form. The cis or trans configuration of said mono-unsaturated fatty acid methyl esters affects the technical characteristics. A cis double bond generates a bend in the carbon chain while the trans double bond rather has an extended structure.

The unsaturated fatty acids are present in majority in their "cis" form in the natural state. The "trans" form is present in the natural state in an amount from about 2 to 8% by weight in milk fats, in an amount of about 4.5% by mass in beef and mutton meat fats. However it is obtained in majority during industrial processes for hydrogenating poly-unsaturated fatty chains present in certain oils. Preferentially, these fatty acid methyl ester bases contain less than 5% by weight, of unsaturated fatty acid methyl esters having at least one unsaturation of their olefinic chain in the trans form (hereafter "trans unsaturated fatty acid methyl esters").

The fatty acid esters may be obtained from fatty acids themselves stemming from natural resources or else from synthetic fatty acids, obtained for example from petroleum cuts. By fatty acids are designated here mono-acids with a linear hydrocarbon chain including from 8 to 24 carbon atoms. They may be saturated, mono-unsaturated or poly-unsaturated. The fatty acids from natural resources include an even number of carbon atoms.

These are for example methyl esters of palmitoleic acid (16-1), oleic acid (18-1), linoleic acid (18-2), linolenic acid (18-3), eicosenoic acid (20-1), erucic acid (22-1) or nervonic acid (24-1). Oleic acid methyl ester is more preferred (18-1). Among the fatty acid methyl esters above, in particular those of palmitoleic acid (16-1), oleic acid (18-1), linoleic acid (18-2) will be preferred as majority compounds. Oleic acid methyl ester is more preferred.

They are for example present in vegetable oils as triglycerides, or glycerol triesters. Hydrolysis of the triglycerides leads to the corresponding fatty acids and to glycerol. Methyl esters are obtained by esterification of the fatty acids or directly by transesterification of the oils with methanol.

As natural oil, mention may be made of coprah, palm, olive, groundnut, rapeseed and sunflower oils, either conventional or genetically modified so as to enrich their oleic acid content (oleic rapeseed and sunflower), soya bean, cotton, beef tallow oils . . . . Preferentially, the fatty acid methyl ester bases used in the invention are of natural origin, particularly of plant oil origin, for example obtained from palm, olive, groundnut oil or from conventional or oleic rapeseed or sunflower oils.

The bases of the fatty acid methyl ester type used in the invention typically have a kinematic viscosity at 100° C., as measured by ASTM D445, comprised between 1.5 and 10 $mm^2/s$, preferentially between 1.5 and 7 $mm^2/s$, and a VI (ASTM 2270) of the order of 250 to 400. The VI of these bases is typically greater than 250, preferentially greater than 280, or further greater than 300, or of the order of 320 and above. They are used as a lubricating base in the compositions according to the present invention, and represent at least 30% by weight of the finished lubricant, preferentially at least 35% by weight. They may be present up to contents of the order of at least 50%, or 60%, or 70%, or even at least 80% by weight based on the total weight of lubricant.

The lubricants according to the invention, formulated with fatty acid methyl ester bases with a high VI as described above, exhibit excellent results in fuel savings when they are for example used as an oil for a gear box. They also have very good thermal stability, as measured during tests of the GFCT-021-A-90 type, when bubbling of air is replaced with nitrogen bubbling.

In order to avoid any ambiguity, it is specified that the minimum amount of 30% of fatty acid methyl esters present in the compositions according to the invention, and the minimum amount of 85% of fatty acid methyl esters present in the bases of the fatty acid methyl ester type described above, do not take into account any possible esters in the form of sulfur-containing, phosphorus-containing or phosphorus-sulfur compounds which are known as anti-wear and extreme pressure agents. These amounts do not either take into account possible borate esters known as friction modifying additives.

Polyalphaolefins and PMA:

Heavy Polyalphaolefins:

The polyalphaolefins used in the lubricating compositions according to the present invention are said to be heavy or viscosity polyalphaolefins. By mixing them with esters and optionally PMA, described above, it is possible to attain in the lubricating compositions according to the invention, the desired viscosity target (between 5.5 and 7 $mm^2/s$, preferentially between 6 and 7 $mm^2/s$, still more preferentially between 6 and 6.7 $mm^2/s$ at 100° C.), without degrading the VI, which remains greater than 250. The compounds of the "heavy" polyalphaolefin (PAO) type or "viscosity" polyalphaolefin type entering the composition according to the invention are selected from PAOs with a kinematic viscosity at 100° C. measured according to ASTM D445 comprised between 40 and 3,000 $m^2/s$, preferentially comprised between 150 and 1,500, preferentially between 300 and 1,200 $mm^2/s$.

Their molecular mass by weight Mw is greater than 2,500 daltons, typically of the order of 4,000 to 50,000 approximately. Their number average molecular mass Mn is greater than 2,500 daltons, typically comprised between 3,000 and 20,000, preferentially between 3,000 and 10,000, preferentially between 3,000 and 7,000. Their polydispersity index Mw/Mn is of the order of 1.1 to 5 and more.

These polyalphaolefins are for example obtained from monomers such as octene, decene, dodecene, tetradecene, hexadecene, etc. . . . , alone or as a mixture with other olefins. They may be used alone or as a mixture in the compositions according to the invention, and represent at least 10% by weight of said compositions. Their mass percentage is preferably less than 30% by weight in said compositions, in order to avoid solubility constraints of the additives or too high viscosity constraints. In other words, the mass percentage of heavy polyalphaolefins will be sufficiently high in order to give the compositions the required viscosity, but should remain within certain limits in order to avoid leading to too viscous compositions or generating solubility problems of the additives.

It is typically comprised between 10 and 25%, or 10 and 20% by weight or between 15 and 25% by weight or between 10 and 18% by weight, preferentially between 15 and 18% by weight of the lubricants for a gear box according to the invention. Preferably, when the lubricating compositions for gear boxes according to the invention contain heavy PAOs as described above, the percentage of fatty acid methyl esters of formula $RCOOCH_3$, wherein R is a paraffinic or olefinic group containing from 11 to 23, preferentially from 13 to 19 carbon atoms, in said compositions, is greater than 60%. Preferentially, they then contain at least 50% by weight, preferentially at least 55% by weight of at least one fatty acid methyl ester of formula $R_1COOCH_3$, wherein $R_1$ is a mono-, di- or tri-unsaturated olefinic group containing from 11 to 23, preferentially from 15 to 19 atoms, preferentially 17 carbon atoms. Still more preferentially, they then contain at least 45% by weight, preferentially at least 50% by weight of at least one fatty acid methyl ester of formula $R_2COOCH_3$, wherein $R_2$ is a mono-unsaturated olefinic group containing from 11 to 23, preferentially from 15 to 19 atoms, preferentially 17 carbon atoms.

PMA and Lightweight Polyalphaolefins:

The compositions according to the invention may be formulated with significant levels of unsaturated fatty acid methyl ester base (50% by weight of the base, or even 60, 70% and beyond, which respectively corresponds to percentages of unsaturated $C_{12}$-$C_{24}$, preferentially $C_{16}$-$C_{24}$ preferentially $C_{18}$ fatty acid methyl esters, of the order of 35% of 35%, 45% or 50% or more based on the total weight of lubricant). This being the case, these compositions have the drawback of not being compatible with all the grades of elastomeric gaskets, notably those of the acrylate and fluoroelastomer type. For this purpose, in an alternative of the invention, a portion of the amount of ester base used is substituted in order to replace it with one or more compounds of the polymethacrylate type (PMA), which are compounds well-known to one skilled in the art, notably occurring as thickening polymers in lubricating formulations.

The PMAs of the present invention have a kinematic viscosity at 100° C., measured according to the ASTM D445 standard, preferably of less than 500 $mm^2/s$, or still less than 250 $mm^2/s$ or further of the order of 200 $mm^2/s$. Preferentially, the mass percentage of PMA will be selected so that the mixture of fatty acid methyl ester and of PMA represents at least 60% by weight in the lubricants according to the invention. Preferentially, the mass percentage of PMA will substantially be equivalent to that of fatty acid methyl esters, i.e. the ratio between the mass percentage of polymethacrylate(s) and the mass percentage of fatty acid ester(s) is comprised between 0.8 and 1.2. The addition of these PMAs does not notably degrade the VI of the compositions according to the invention.

In order to facilitate their mixing in a lubricating composition, commercial polymethacrylates appear as compounds consisting of polymer in predilution base oil. Said polymethacrylate compounds thus consist of 30 to 60% by weight, typically 50% by weight of polymer (active material), in the predilution oil. The mass percentages of PMA mentioned in the present description refer to the percentage of compound formed by the polymer mixture (active material) plus the predilution oil.

The PMAs used in the compositions according to the invention have a rather low molecular mass by weight, of less than 30,000 daltons. Their incorporation however forces incorporation of a co-solvent, with which it will be also possible to observe the kinematic viscosity target at 100° C. comprised between 5.5 and 7 $mm^2/s$ and to improve compatibility with the elastomers for the lubricants according to the invention. This co-solvent should not either degrade the VI of the compositions. Thus, in alternatives of the invention comprising PMAs, lightweight polyalphaolefins PAO are incorporated as a co-solvent of said PMAs. The PMAs as described above are thickening additives well-known to one skilled in the art, the role of which is to increase hot and cold viscosity alike.

In an alternative of the invention, one or several other thickening additives also known to one skilled in the art are used as an alternative to these PMAs, in combination with the lightweight polyalphaolefins described hereafter as a co-solvent. These other thickening additives may be used alone or as a mixture, and optionally as a mixture with the PMAs, exactly under the same conditions as with the PMAs. These other thickeners will be selected for their high VI (greater than 200, preferentially greater than 250, or further greater than 280, or further greater than 300, preferentially of the order of 320 or more), and for their shear resistance adapted to a use in lubricants for a gear box.

It is thus possible to use, in order to substitute a portion of the ester base amount used in the compositions according to the invention, polyalphaolefin (PAO)/ethylene copolymers, such as for example LUCANT® marketed by Mitsui, or ethylene-propylene dimers (EPDM), such as TRILENE CP 80 marketed by LYON Copolymers, or styrene-acrylate copolymers or derivatives or copolymers of PMA. Polyisobutenes (PIB) do not provide sufficient VI, and OCP or starpolymers are not stable to shearing. Some of these compounds, such as EPDM, appear as liquid compounds quasi exclusively consisting of polymeric active material (i.e. for example Trilene quasi exclusively consists of EPDM).

Other ones appear as compounds consisting of polymer (active material) in predilution base oil. This is for example the case of PAO/ethylene copolymers, which consist of 30 to 60% by weight, typically 50% by weight of polymer (active material) in the predilution oil. When this is the case, the mass percentages of thickeners mentioned in the present description, refer to the percentage of compound formed by the polymeric mixture (active material) plus the predilution oil.

Preferentially, the mass percentage of the thickeners, alone or as a mixture, or as an optional mixture with the PMAs described above, will be selected so that the mixture of fatty acid methyl ester, of thickener(s), and of optionally PMA, represents at least 60% by weight in the lubricants according to the invention. Preferentially, the mass percentage of the thickener(s), or of the mixture of thickeners and PMA, will substantially be equivalent to that of the fatty acid methyl esters. That is to say that the ratio between the mass percentage of the thickener(s) or of the mixture of thickeners and PMA, and the mass percentage of fatty acid ester(s) is comprised between 0.8 and 1.2.

Lightweight PAOs:

Like the heavy polyalphaolefins, lightweight polyalphaolefins are for example obtained from monomers such as octene, decene, dodecene, tetradecene, hexadecene, etc. . . . , alone or as a mixture with other olefins. They may also be used alone or as a mixture in the compositions according to the invention. So-called lightweight PAOs have a kinematic viscosity at 100° C. measured according to the ASTM D445 standard, comprised between 1.5 and 6 $mm^2/s$, preferentially less than 3 $mm^2/s$, of the order of 2 $mm^2/s$, a kinematic viscosity at 40° C. measured according to the ASTM D445 standard comprised between 4 and 32 $mm^2/s$, preferentially less than 6 $mm^2/s$, of the order of 5 $mm^2/s$, and a molecular mass by weight (obtained by gas chromatography) of less than 500, preferentially less than 300, typically of the order of 290 or 285 Daltons.

They preferably represent at least 10% by weight of the lubricants for a gear box according to the invention. Their mass percentage is preferably less than 30% by weight in said lubricants, so as to avoid solubility constraints of the additives. In other words, the mass percentage of lightweight polyalphaolefins will be sufficiently high in order to solubilize the amounts of PMA (and/or other thickeners as described above) required for giving the compositions the required viscosity, but it should remain within certain limits in order to avoid the solubility problems of the additives. Typically, their mass percentage is comprised between 10 and 25%, preferentially between 15 and 25% by weight, of the compositions according to the invention.

Preferentially, the mass percentage of lightweight PAOs is at least 10% and the mass percentage of PMA(s) (and/or other thickeners described above) will be selected so that the fatty acid methyl ester mixture with the PMA(s) and/or with the other thickeners as described above, represents at least 60% by weight in the lubricating compositions for gear boxes according to the invention. Still more preferentially, the mass percentage of PMA(s) and/or of other thickener(s) as described above, will be substantially equivalent to that of fatty acid methyl esters, i.e. the ratio between the mass percentage of polymethacrylate(s) and the mass percentage of fatty acid ester(s) is comprised between 0.8 and 1.2.

The thereby formulated compositions according to the invention, with fatty acid methyl ester bases, with PMA and lightweight PAO, have less aggressiveness than the alternatives only containing methyl ester and heavy PAO, during dynamic tests conducted on gaskets of various grades. In particular, less change in volume and less deterioration of the mechanical properties are observed on fluoroelastomer gaskets. Moreover, quasi absence of insoluble materials was noticed for the oils according to the invention containing PMA and lightweight PAO, after oxidation tests GFCT-021-A-90 at 160° C., which is a significant improvement as compared with the other alternative. When thermal ageing tests are carried out, under the conditions of GFCT-021-A-90, at 160° C., and by replacing air bubbling with nitrogen bubbling, initial thickening is seen, probably due to a transesterification phenomenon between the PMA and the methyl ester, and then subsequent stability of the product.

Other Base Oils:

The lubricating compositions according to the invention may contain as lubricating bases, in addition to the fatty acid methyl esters described above, in combination with heavy PAOs or lightweight PAOs and PMAs, any type of lubricant bases known to one skilled in the art, insofar that the VI of said lubricating compositions is greater than 250, preferentially greater than 280, still more preferentially greater than 300, or of the order of 320 and more, and the kinematic viscosity at 100° C. of said lubricating compositions is comprised between 5.5 and 7 $mm^2/s$. These base oils may be of mineral, synthetic or natural origin. The mineral base oils may include any types of bases obtained by atmospheric and in vacuo distillation of crude oil, followed by refining operations such as extraction with a solvent, deasphalting, dewaxing with a solvent, hydrotreatment, hydrocracking and hydroisomerization, hydrofinishing . . . .

Synthetic base oils may include oils belonging to the groups IV, V and VI of the API classification, including polyalphaolefins, poly(internal olefins), alkylaromatics, alkylbenzene, alkylnaphthalenes, esters, diesters, polyol esters such as pentaerythritol esters, alphaolefin oligomers and ester oligomers, polyalkylene glycols. Preferentially, no base containing fatty acid esters other than the bases of the fatty acid methyl ester type described above will be used.

Viscosity and VI of the Oils According to the Invention:

The oils according to the invention are characterized by a very high VI. Their VI, measured according to the ASTM 2270 standard, is greater than 250, preferentially greater than 280, or further greater than 300, of further of the order of 320 and more. They are also characterized by low viscosity at operating temperatures (viscosity values at the temperature of use, value of the temperatures of use), and a kinematic viscosity at 100° C., KV100, measured according to the ASTM D445 standard, comprised between 5.5 and 7 $mm^2/s$, preferentially comprised between 6 and 6.5 $mm^2/s$.

The viscosity behavior of the lubricants is determined by the bases and the thickening and VI modifier additives used in their formulation. In particular, it is important in order to attain very high VI values of the oils according to the invention, that the mono-unsaturated fatty acid methyl ester(s) used themselves have a very high VI. Now, the VI of these unsaturated fatty acid methyl esters is strongly affected by the presence of impurities, notably by the presence of esters of unsaturated fatty acids and of alcohols other than methanol, for example ethanol. Commercial fatty acid methyl esters thus have VIs which may vary in a very large range, as shown by the VI values of commercial oleates above, extracted from the Unichema catalog.

| | | |
|---|---|---|
| Methyl oleate | KV 100 = 1.8 | VI = 320 |
| Isopropyl oleate | KV 100 = 2.0 | VI = 221 |
| Isobutyl oleate | KV 100 = 2.3 | VI = 229 |
| 2-ethylhexyl oleate | KV 100 = 2.7-2.8 | VI = 159 |

Antiwear and/or Extreme Pressure Additives:

The lubricating compositions according to the present invention contain at least one phosphorus-sulfur-containing, sulfur- or phosphorus-containing antiwear and/or extreme pressure agent, preferentially present at contents comprised between 0.01 and 12%, preferentially between 0.01 and 5% by weight based on the total weight of lubricants. The compositions according to the invention preferentially contain both the sulfur element and the phosphorus element. Preferentially, they contain either at least one phosphorus-containing additive and at least one sulfur-containing additive, or at least one phosphorus-sulfur additive. The mass contents of the element sulfur are typically of the order of 1 to 3% by weight (according to the formulations and the goals) and the phosphorus contents of the order of 500 to 3,000 ppm (according to the formulations and the goals).

Phosphorus-Sulfur Antiwear and Extreme Pressure Additives:

Phosphorus-sulfur antiwear and extreme pressure additives used in the present invention are for example and in a non-limiting way, thiophosphoric acid, thiophosphorous acid, esters of these acids, salts and dithiophosphates, particularly zinc dithiophosphates. As examples of phosphorus-sulfur antiwear and extreme pressure additives, mention may be made of those which include 1 to 3 sulfur atoms, such as monobutylthiophosphate, monooctylthiophosphate, monolaurylthiophosphate, dibutyl-thiophosphate, dilaurylthiophosphate, tributylthiophosphate, trioctythiophosphate, triphenylthiophospate, trilauryl-thiophosphate, monobutylthiophosphite, monooctylthiophite, monolaurylthiophosphite, dibutylthiophosphite, dilauryl-thiophosphite, tributylthiophosphite, trioctylthiophosphite, triphenylthiophosphite, trilaurylthiophosphite and their salts. Examples of salts of the esters of thiophosphoric acid of thiophosphorous acid are those obtained by reaction with a nitrogen-containing compound such as ammonia or an amine or with zinc oxide or zinc chloride.

Phosphorus-Containing Antiwear and Extreme Pressure Additives:

The lubricating compositions according to the present invention may also contain phosphorus-containing antiwear and extreme pressure additives, such as for example alkyl phosphates or alkyl phosphonates, phosphoric acid, phosphorous acid, mono-, di- and tri-esters of phosphorous acid and of phosphoric acid and their salts.

Sulfur-Containing Antiwear and Extreme Pressure Additives:

Mention may for example be made of sulfur-containing antiwear and extreme pressure additives, of dithiocarbamates, thiadiazoles and benzothiazoles, sulfur-containing olefins. The most current sulfur-containing olefins are further called SIBs, for "Sulfurized IsoButylenes". These sulfur-containing olefins are generally obtained by a sulfurization reaction of olefins with sulfur, hydrogen sulfide or alkaline metal sulfide hydrates, for example sodium sulfide.

Certain particular sulfur-containing olefins may be obtained by catalytic methods, for example by reaction of hydrogen sulfide with isobutylene in the presence of a catalyst. These methods lead to purer products, with a better defined structure, having a higher sulfur content (ASTM D2622) and a generally lower active sulfur content (ASTM D-1662) than currently used SIBs.

S/P Ratio:

In the lubricating compositions for transmissions, the sulfur content of the base oil or of the base oil mixture, as well as the respective amounts of phosphorus-sulfur, phosphorus-containing, and sulfur-containing extreme pressure additives, notably sulfur-containing olefins, are generally selected so that said compositions have a ratio between their sulfur element content, as measured by the ASTM D2622 standard and their phosphorus element content, as measured by the ASTM D5185 standard, i.e. S/P, comprised between 3 and 60. The transmission lubricants having a ratio S/P greater than 30 are generally products of the "economical" type with a very low additive treatment level and reduced phosphorus contents.

Mixed products for gear boxes and driving axles generally have an S/P value comprised between 20 and 30, preferentially close to 20, which corresponds to minimizing the amount of sulfur for improving compatibility with synchromeshes. The products having a ratio of less than 20 are intended for gear boxes rather than for driving axles. The lubricating compositions according to the present invention have an S/P ratio as defined above, comprised between 3 and 60, or further between 5 and 60, more preferentially less than 30, preferentially less than 20, still more preferentially less than 15 or than 10.

Other Additives:

The lubricating compositions according to the invention may also contain any types of additives adapted to their use, known to one skilled in the art for their use in formulations of oils for transmissions, for example one or several additives selected from friction modifier additives, antioxidant additives (for example amine antioxidants), corrosion inhibitors, present at the usual levels required for the application.

Friction Modifiers:

Friction modifier additives allow limitation of friction under limiting or mixed lubrication conditions by forming monolayers adsorbed on the surfaces of metals; the fatty acid methyl esters used as a base in the lubricants according to the invention have this property. However, when they are used as friction modifier additives in lubricating compositions, their mass percentage is less than 10%, generally comprised between 0.01 and 5% by weight based on the total weight of the lubricating composition. Said lubricants according to the invention may further contain, as friction modifiers, molecules such as fatty acids, fatty amines, either ethoxylated or not, fatty acids, amides obtained from fatty acids and amines, or further succinimides formed by reaction of aliphatic succinic acids and primary amines, imidazoles, tertiary amines, aliphatic phosphonates, phosphates, thiophosphonates, aliphatic thiophosphotes, organic derivatives of molybdenum. The aliphatic chains of these compounds generally have a minimum of 8 carbon atoms.

Other friction modifier additives may contain combinations of di-hydroxyalkylamines, N-substituted with an aliphatic group having about 14 to 20 carbon atoms, optionally combined with trimethylene diamines, having at least one aliphatic N-substituent, or with imidazoles N-substituted with aliphatic hydroxyalkyl groups. These compounds may preferentially be present at levels comprised between 0.01% and 10% by weight in the lubricants according to the present invention.

Pour Point Depressants:

The compositions according to the invention may contain one or more additives of a pour point depressant additive. For example these may be polyacrylates, ethyl-vinyl acetates, ethylene copolymers, condensation derivatives of naphthalene. These additives may typically be present in an amount from 0.1 to 2% by weight.

Anticorrosion Agents and Copper-Passivating Agents:

These are for example compounds such as polyisobutene succinic anhydrides, sulfonates, thiadiazoles, mercaptobenzothiazole. They are typically present in the lubricating compositions according to the invention at levels comprised between 0.01 and 1% by weight.

The oils according to the invention may also contain all types of additives suitable for their use, and notably:

detergents such as for example calcium, sodium, magnesium, barium sulfonates, salicylates, present at levels comprised between 0 and 5% by weight, dispersants such as derivatives of polyisobutylene succinic anhydride, between 0 and 5%, antioxidants, which may for example be amine antioxidants (octadiphenylamines, phenyl-alpha-naphthyl amines, . . . ) phenolic antioxidants (BHT and derivatives), sulfur-containing antioxidants (sulfurized phenates).

The present invention also relates to the use of the lubricating compositions for gear boxes as described above for generating fuel savings of more than 1%, preferentially more than 2.5%, as measured under the standard conditions of the NEDC test according to the Directive EEC 90/C81/01 setting the national upper emission limits for certain atmospheric pollutants ("emission test cycles for the certification of light duty vehicles in Europe", Brussels, 2001), on motor vehicles. The compositions according to the invention are particularly suitable for generating fuel savings on light duty gasoline or diesel vehicles, or equipped with a hybrid electric motor. Indeed, in the operation of a hybrid motor, the kinetic energy is recovered and accumulated during braking for subsequent restoration. The gear box oil therefore has an all the more significant impact on fuel-savings generated in such a vehicle since the gear box is also actuated in deceleration phases.

Another aspect of the invention also relates to the use of bases of the fatty acid methyl ester type as described above as a lubricating base for formulating oils for gear boxes generating fuel savings of more than 1%, preferentially more than 2.5%, measured under the standard conditions of the NEDC test according to the Directive EEC 90/C81/01 setting the national upper emission limits for certain atmospheric pollutants ("emission test cycles for the certification of light duty vehicle in Europe", Brussels, 2001). These bases are preferentially used at levels of at least 30% by weight of the finished lubricant, preferentially at least 35% by weight. They may be present up to levels of the order of at least 50%, or 60%, or 70%, or even at least 80% by weight based on the total lubricant weight.

Of course, the present invention is not limited to the examples and to the described and illustrated embodiment, but it may have many alternatives accessible to one skilled in the art.

Example 1

Preparation of Lubricating Compositions

Lubricating compositions according to the invention (oils A and B) are prepared, comprising at least 35% by weight of a lubricating base consisting in majority of unsaturated fatty acid methyl esters, and the characteristics of which are grouped in the Table 1. The percentages are mass percentages based on the total weight of lubricant.

TABLE 1

| base of unsaturated fatty acid methyl esters | |
|---|---|
| | Base of fatty acid methyl esters |
| Fatty acid methyl esters (EN 14103) | |
| Content of methyl esters of $C_{12}$-$C_{24}$ fatty acids (g/100 g of base, according to the EN 14103 standard) | 93.2 |
| Saturated methyl ester content, (g/l00 g of base, according to the EN 14103 standard) | 9.2 |
| Content of methyl esters of mono-, di-, tri-unsaturated cis $C_{16}$-$C_{20}$ acids, (g/l00 g of base, according to the EN 14103 standard) | 80.6 |
| Content of methyl esters of mono-unsaturated cis $C_{16}$-$C_{20}$ acids, (g/l00 g of base, according to the EN 14103 standard) | 73.1 |
| Methyl oleate content (g/100 g of base, according to the EN 14103 standard) | 64.9 |
| Free and total glycerol (EN 14105) | |
| Free glycerol (g/l00 g of base) | <0.005 |
| Monoglycerides (g/l00 g of base) | <0.005 |
| Diglycerides (g/l00 g of base) | 0.01 |
| Triglycerides (g/l00 g of base) | 0.09 |
| Total glycerol (g/l00 g of base) | 0.011 |

TABLE 1-continued

| base of unsaturated fatty acid methyl esters | |
|---|---|
| | Base of fatty acid methyl esters |
| Average fatty acid chain length | 17.7 |
| KV 100 (ASTM D445), mmVs. | 2.3 |
| VI (ASTM D2270) | 320 |

The heavy PAO used in the oils A is available under the commercial reference Spectracyn 1000 from ExxonMobil Chemicals, having a kinematic viscosity at 100° C. of 1,000 $mm^2/s$. The light PAO used in the oil B is marketed by Exxon Mobil Chemicals under the reference SHF-23, having a kinematic viscosity at 100° C. of 1.8 $mm^2/s$. The polymethacrylate used in the oils A and B is PAS 501 provided by Sanyo Chemical.

The additivation of the thereby prepared compositions according to the invention is a standard additivation of lubricants for a gear box. These compositions comprise 9.5% by mass of the package for gears marketed by Lubrizol under the reference OS 215497, and containing:

a phosphorus-containing antiwear agent, a sulfur-containing extreme pressure agent, a corrosion inhibitor of the dimercaptanbenzothiazole type, an amine antioxidant.

Table 2 groups the characteristics of the oils A and B according to the invention. The indicated % are mass % based on the total weight of the lubricant.

TABLE 2

| characteristics of the oils according to the invention | | | | |
|---|---|---|---|---|
| Trade name | Chemical nature | Function | A | B |
| OS 215497 | | Gear package | 9.5% | 9.5% |
| Sturaco 7098S | Amine phosphate | Friction modifier | 0.5% | 0.5% |
| Fatty acid methyl ester base | Fatty acid methyl esters | Base | 73.8% | 35.45% |
| PAS 501 | PMA | Base | — | 34.5% |
| Spectracyn 100 | Heavy PAO KV 100 1000 8 $mm^2/s$ | Thickener & VI enhancer | 16 | — |
| PAO 2 SHF-23 | Lightweight PAO, KV100 1.8 mmVs | Thickener & VI enhancer | — | 20 |
| SM31 | | Antifoam | — | 0.05% |
| Viscoplex 1-256 | | PPD | 0.2% | — |
| TOTAL: | | | 100% | 100% |
| KV40, $mm^2/s$ (ASTM D445) | | | 19.98 | 21.49 |
| KV 100, $mm^2/s$ (ASTM D445) | | | 6.53 | 6.51 |
| VI (ASTM D2270) | | | 323 | 291 |
| KV-10 $mm^2/s$ (ASTM D445) | | | 119 | |
| S/P (ASTM D2622 and ASTM D5185 respectively) | | | 6.56 | 6.56 |

Example 2

NEDC Test

Measurements of the heating-up of the operating oils and of fuel consumption are conducted by subjecting a test bench engine or that of an actual vehicle to the NEDC model cycle, (also designated as ECE EUDC) according to the directive EEC 90/C81/01 01 setting national upper emission limits for certain atmospheric pollutants ("emission test cycles for the certification of light duty vehicles in Europe", Brussels, 2001). The characteristics of this engine cycle are grouped in FIG. 1, which describes the imposed speed (in km/hour) versus time (in seconds), in the ECE 15 and EUDC cycles, respectively. The NEDC cycle corresponds to 4 ECE cycles and a EUDC cycle: NEDC=4×ECE15+EUDC.

Table 3 below summarizes the overall characteristics of this cycle, representative of the average daily trips in Europe.

TABLE 3

| ECE15 and EUDC cycles | | | |
|---|---|---|---|
| Characteristics | Units | ECE 15 | EUDC |
| Distance | km | 4 × 1.013 = 4.052 | 6.955 |
| Duration | s | 4 × 195 = 780 | 400 |
| Average speed | km/h | 18.7, including stop | 62.6 |
| Maximum speed | km/h | 50 | 120 |

This NEDC cycle is carried out on an engine bench, which uses a gasoline engine with a power of 88 kW, a manual gear box and a Clemessy robot for switching gears. The reference oil (REF) is a commercial oil for a manual gear box used in lightweight private vehicles, of grade 75W80, with a kinematic viscosity of 8 $mm^2/s$ at 100° C. and with a VI of the order of 150, formulated with standard paraffinic bases of Group I (essentially of the Solvent Neutral 150 type).

Example 3

Measurement of the Heating-Up of the Oils During Operation

The initial temperature of the oils is 22° C. The final temperature of the gear box oils tested at the end of the test is copied into Table 4 below. It is observed that the oils according to the invention A and B, formulated with at least 35% by mass of a fatty acid methyl ester type base, lead to heating-ups which are much lower than those of the commercial reference. It is also seen that during tests simulating driving over rather short trips, representative of the average of daily trips, the operating temperature of the gear box oils is comprised between 40 and 50° C.

TABLE 4

| rise in temperature of the oils during operation | | | |
|---|---|---|---|
| | A | B | REF |
| Initial T (° C.) | 22 | 22 | 22 |
| Final T (° C.) | 44.3 | 44.7 | 50 |
| AT (° C.) | 22.3 | 22.7 | 28 |

Example 4

Measurement of Fuel Savings

The fuel consumption is calculated according to the directive EEC 90/C81/01 setting national upper emission limits for certain atmospheric pollutants ("emission test cycles for the certification of light duty vehicles in Europe", Brussels, 2001). The amount of gas emitted in the exhaust is measured and the fuel mass consumption is thereby traced back.

The obtained results are grouped in Table 5 below.

TABLE 5

| Measurement of fuel-savings with the oils according to the invention | | | |
|---|---|---|---|
| | A | B | REF |
| Initial temperature ° C. | 22.0 | 22.0 | 22.0 |
| Final temperature after NEDC, ° C. | 22.3 | 22.6 | 28.0 |
| Fuel savings/REF, after NEDC (mass % of consumption) | 3% | 2.5% | 0% |

It is seen that significant fuel savings are obtained with the oils A and B according to the invention. Heating-up is also limited (5 to 6 degrees less than the reference). Moreover, during NEDC tests as described above, but conducted on hybrid vehicles of greater power, equipped with automatic gear boxes, these oils have exhibited fuel savings of the order of 3%. The hybrid vehicle used included an automated mechanical gear box in order to apply a switching strategy specific to the optimization of hybrid exploitation.

It should be noted that for automated gear boxes, the directive EEC 90/C81/01 does not impose, like for manual gear boxes, points for switching gears. The latter are managed in an optimized way by a computer. It is therefore difficult to compare these last test results with the previous ones. However, in operating a hybrid engine, slowing down (with energy recovery) is performed for braking. Therefore it may reasonably be imagined that gear box oil therefore has an impact all the more significant on fuel savings generated in such a vehicle.

Example 5

Correlation Between Fuel Savings and Kinematic Viscosity at 40° C.

Taking into account the operating temperature conditions, fuel savings under the conditions described above in Example 4 were measured for different gear box oils, and these savings were correlated with their kinematic viscosity at 40° C.

The results are grouped in Table 6 below:

TABLE 6

| correlation between fuel savings and kinematic viscosity at 40° C. | | | | | | |
|---|---|---|---|---|---|---|
| | A | B | H | C | G | REF |
| KV 40, mm2/s | 19.98 | 21.49 | 26.60 | 29.80 | 31.10 | 48.10 |
| Fuel savings/REF, after NEDC (mass % of consumption) | 3% | 2.5% | 2% | 0.8% | 1.5% | 0% |

The oils A and B are oils according to the invention, the characteristics of which are displayed in Table 2, and REF is the reference for fuel consumption described above. The oil C is a gear box oil having the same additivation as oils A and B, but formulated from mineral bases of group I and III with a VI of 160. The oil G is oil for a gear box formulated from bases of group I, KV 100=8,000 $mm^2/s$, VI of the order of 150. Oil H is similar to oil C with a VI of 200. It is seen that the achieved fuel savings are all the higher since the kinematic viscosity at 40° C. is low, with a quasi-linear correlation.

Example 6

Level of Insoluble Materials in the Oils According to the Invention

An oxidation test was conducted according to the GFCT-021-A-90 standard, at 140° C., on oils according to the invention. The oils A and B are those for which the characteristics are exhibited in Table 2. The results are grouped in Table 7 below.

TABLE 7

| oxidation tests at 140° C., GFCT-021-A-90. | | |
|---|---|---|
| | A | B |
| New oil | | |
| KV40, $mm^2/s$. | 19.98 | 21.49 |
| KV100, $mm^2/s$. | 6.53 | 6.51 |
| End of test | | |
| KV40, $mm^2/s$. | 64.95 | |
| KV100, $mm^2/s$. | 14.02 | 165.4 |
| Insolubles (mass % ) | 19.3 | 0.6 |

Not surprisingly, it is seen that the oils according to the invention poorly resist to high temperature oxidizing conditions, with a significant increase in their kinematic viscosity. However, their level of insoluble materials is low. In particular, the oils B, formulated with fatty acid methyl esters combined with PMAs and lightweight PAOs, have an exceptionally low level of insoluble materials.

Example 7

Thermal Stability of the Oils According to the Invention

A thermal ageing test was conducted on the oils A and B according to the invention. This test is accomplished under the conditions of the standardized test GFCT-021-A-90, at 160° C., but bubbling with nitrogen is substituted for bubbling with air so as to be placed under non-oxidizing conditions. This lack of oxygen from the air is representative of the confinement in which is placed the gear box oil in operation. The time-dependent change in the kinematic viscosity at 100° C. of the oils A and B according to the invention during the test is copied into the Table 8 below:

TABLE 8

| time-dependent change of the kinematic viscosity at 100° C. versus time, thermal ageing test at 160° C. | | | |
|---|---|---|---|
| | Time (hours) | Oil A | Oil B |
| Kinematic viscosity at 100° C. ($mm^2/s$) | 0 (new oil) | 6.53 | 6.51 |
| | 24 | 7.44 | 13.83 |
| | 96 | 7.67 | 12.77 |
| | 120 | 7.69 | 12.83 |
| | 144 | 7.74 | 13.43 |
| | 168 | 7.76 | 13.26 |
| | 192 | 7.81 | 13.41 |

It is seen that oil A is very stable in temperature. For oil B, a significant initial increase in viscosity is noticed, but the product remains highly stable over time. The level of insoluble materials measured for both oils is very low, 0.01 and 0.065, respectively, after 200 hours of test.

Oil B therefore has the advantage of an exceptionally low insoluble material level after the oxidation test, with one advantage of the initial thickening noticed during thermal ageing tests. Oil A, as for it, is very stable thermally, with very high levels of insoluble materials during oxidation tests. The acid number passes from 3.5 to 6.5 for the oil A, which shows very low degradation of the fatty acid methyl ester base. The acid number passes from 3.7 to 2.1 for the oil B, which is not surprising if it is considered that the initial thickening phenomenon is due to a transesterification reaction of the fatty acid methyl esters with the heavy alcohols of the PMA.

Example 8

Measurement of the Operating Life Time of the Oils According to the Invention An actual test was conducted on a running vehicle, a Peugeot 307, the manual gear box of which is lubricated with the oil B. The viscosity of the oil representative of its ageing, the levels of certain metal elements, representative of the wear of mechanical parts, as well as the level of certain elements (notably Ca, Zn, P, Mg, Mo, B, Na), were measured and their presence gives the possibility of checking whether the additives of the oil are not degraded. The results are grouped in Table 9 hereafter.

In particular, it is noticed that the viscosity at 100 and at 40° C., has remained constant to within errors of measurement. In fact, a slight decrease of KV 100 is observed: this is the effect of the shearing during operation. In particular, no increase in viscosity due to an oxidation problem of the oil is observed. The VI also remains within values with which an FE effect may be attained.

These excellent results are a priori related to moderate heating-up undergone by oils during operation, and to the confinement of the oils in the gear boxes, which limits contact with oxygen of the air. The (P, Ca, Zn) element content in the main additives for gear boxes measured by ICP also remains constant to within errors of measurement. A slight "increase" of their content is observed: this may be due to evaporation, but more likely due to the "natural" uncertainty of the measurements on ICP under the follow-up conditions, as well as to the representativity of the sampling. The observed wear levels are low and do not allow detection of any abnormality in the protection of the members of the gear box by the lubricant. The low acid number measured on the oil after 30,000 km of a vehicle test also allows the conclusion to be drawn on the absence of degradation of the esters used as a lubricating base.

TABLE 9 time-dependent change of the physico-chemical parameters and of the element contents of the oil during operation.

| | B (initial) | B (after 30,000 km vehicle test) |
|---|---|---|
| Oil | | |
| KV 40° C. ($mm^2/s$, ASTM D445) | 21.49 | 22.5 |
| KV 100° C. ($mm^2/s$, ASTM D445) | 6.51 | 6.3 |
| VI (ASTM D2270) | 291 | 258 |
| Additives | | |
| Calcium ppm | 3480 | 3579 |
| Zinc ppm | 1640 | 1686 |
| Phosphorus ppm | 2180 | 2296 |

TABLE 9-continued time-dependent change of the physico-chemical parameters and of the element contents of the oil during operation.

| | B (initial) | B (after 30,000 km vehicle test) |
|---|---|---|
| Wear | | |
| Fe ppm | — | 47 |
| Pb ppm | <0.6 | 4 |
| Cu ppm | — | 18 |
| Sn ppm | — | <1 |
| Cr ppm | — | 1 |
| Al ppm | — | 6 |
| Ni ppm | — | <1 |
| Acid number | | 2.6 |

The invention claimed is:

1. A lubricating composition for gearboxes, with a kinematic viscosity at 100° C. measured according to the ASTM D445 standard of between 5.5 and 7 $mm^2/s$, comprising:

(a) one or more phosphorus-containing, sulfur-containing, or phosphorus-sulphur-containing antiwear and/or extreme pressure additives;

(b) at least 30% by weight of at least one fatty acid methyl ester of formula $RCOOCH_3$, wherein R is a paraffinic or olefinic group containing from 11 to 23 carbon atoms; and (c) at least one compound selected from the group of light polyalphaolefins with kinematic viscosity at 100° C., measured according to the ASTM D445 standard, comprised between 1.5 and 6 $mm^2/s$, with a kinematic viscosity at 40° C., measured according to the ASTM D445 standard, comprised between 4 and 30 $mm^2/s$ and with a molecular mass by weight of less than 500 daltons in combination with one or more compounds of polymethacrylate type, with a molecular mass by weight of less than 30,000 daltons, and wherein the mass percentage of light polyalphaolefin(s) is at least 10%, and wherein the mass percentage of the polymethacrylate(s) and the fatty acid methyl ester(s) is collectively at least 60%.

2. The lubricating composition according to claim 1, comprising at least 20% by weight of at least one fatty acid methyl ester of formula $R_1COOCH_3$, wherein $R_1$ is a mono-, di- or tri-unsaturated olefinic group containing from 11 to 23 carbon atoms.

3. The lubricating composition according to claim 1, comprising at least 20% by weight of at least one fatty acid methyl ester of formula $R_2COOCH_3$, wherein $R_2$ is a mono-unsaturated group containing from 11 to 23 carbon atoms.

4. The lubricating composition according to claim 2, wherein the unsaturations of the olefinic group $R_1$ is in the cis configuration.

5. The lubricating composition according to claim 1, wherein the ratio between the mass percentage of polymethacrylate(s) and the mass percentage of fatty acid ester(s) is comprised between 0.8 and 1.2.

6. The lubricating composition according to claim 1, comprising at least 85% by weight of one or more fatty acid methyl esters of formula $RCOOCH_3$, wherein R is a paraffinic or olefinic group containing from 11 to 23 carbon atoms, based on the total weight of fatty acid esters present in said lubricant composition.

7. The lubricating composition according to claim 6, comprising at least 75% by weight of at least one fatty acid methyl ester of formula $R_1COOCH_3$, wherein $R_1$ is a mono-, di- or tri-unsaturated olefinic group containing from 11 to 23 carbon atoms, based on the total weight of fatty acid esters present in said lubricant composition.

8. The lubricating composition according to claim 6, comprising at least 65% by weight of at least one fatty acid methyl ester of formula $R_2COOCH_3$, wherein $R_2$ is a mono-unsaturated group containing from 11 to 23 carbon atoms, based on the total weight of fatty acid esters present in said lubricant composition.

9. The lubricating composition according to claim 7, wherein the unsaturations of the olefinic group $R_1$ is in the cis configuration.

10. The lubricating composition according to claim 6, comprising at most 15% by weight of saturated fatty acid esters, based on the total weight of fatty acid esters present in said lubricant composition.

11. The lubricating composition according to claim 1, wherein the ratio S/P between the mass content of the sulfur element measured according to the ASTM D2622 standard and the content of the phosphorus element measured according to the ASTM D5185 standard in the lubricating compositions is comprised between 3 and 60.

12. The lubricating composition according to claim 1, wherein its VI, measured according to the ASTM D2270 standard, is greater than 250.

13. A method for lubricating gearboxes comprising contacting the gearboxes with a lubricating composition for gearboxes, with a kinematic viscosity at 100° C. measured according to the ASTM D445 standard, comprised between 5.5 and 7 $mm^2/s$, wherein the method generates fuel savings of more than 1%, measured under standard conditions of the NDEC test according to the Directive EEC 90/C81/01 on motor vehicles, and wherein the lubricating composition comprises:

(a) one or more phosphorus-containing, sulfur-containing, or phosphorus-sulphur-containing antiwear and/or extreme pressure additives, (b) at least 30% by weight of at least one fatty acid methyl ester of formula $RCOOCH_3$, wherein R is a paraffinic or olefinic group containing from 11 to 23 carbon atoms; and (c) at least one compound selected from the group of light polyalphaolefins with a kinematic viscosity at 100° C., measured according to the ASTM D445 standard, comprised between 1.5 and 6 $mm^2/s$, with a kinematic viscosity at 40° C., measured according to the ASTM D445 standard, comprised between 4 and 30 $mm^2/s$, and with a molecular mass by weight of less than 500 daltons in combination with one or more compounds of the polymethacrylate type, with a molecular mass by weight of less than 30,000 daltons, and wherein the mass percentage of light polyalphaolefin(s) is at least 10%, and wherein the mass percentage of polymethacrylate(s) and the fatty acid methyl ester(s) is collectively at least 60%.

14. The method according to claim 13, wherein the fuel savings are generated on engines of light duty vehicles.

15. The method according to claim 13, wherein the vehicles are equipped with manual or automatic or automated manual gearboxes.

16. The lubricating composition according to claim 3, wherein the unsaturation of the olefinic group $R_2$ is in the cis configuration.

17. The lubricating composition according to claim 8, wherein the unsaturation of the olefinic group $R_2$ is in the cis configuration.

* * * * *